US005580301A

United States Patent [19]

Muller

[11] Patent Number: 5,580,301

[45] Date of Patent: Dec. 3, 1996

[54] DEVICE FOR FASTENING A LAPPING DISK TO THE AXLE OF A MOTOR OF A LAPPING UNIT USED ON THE RAIL OF A RAILWAY

[75] Inventor: Jacques Muller, Echandens, Switzerland

[73] Assignee: Speno International S.A., Geneva, Switzerland

[21] Appl. No.: 212,568

[22] Filed: Mar. 14, 1994

[30] Foreign Application Priority Data

May 21, 1993 [CH] Switzerland ..... 1537/93

[51] Int. Cl.[6] ..... B24B 41/00

[52] U.S. Cl. ..... 451/342; 451/548; 279/139; 279/4.05

[58] Field of Search ..... 451/342, 508, 451/510, 511, 548; 279/2.05, 4.05, 43.2, 139

[56] References Cited

U.S. PATENT DOCUMENTS

| | | | |
|---|---|---|---|
| 2,744,364 | 5/1956 | Behrendt et al. | 451/511 |
| 4,292,768 | 10/1981 | Panetti . | |
| 4,610,579 | 9/1986 | Frank et al. | 451/548 |
| 4,693,039 | 9/1987 | Vieau et al. | 451/342 |
| 4,731,955 | 3/1988 | Henle | 451/342 |
| 4,809,465 | 3/1989 | Mushardt et al. | 451/342 |
| 5,048,237 | 9/1991 | Lankry | 451/342 |
| 5,326,114 | 7/1994 | Piotrowski | 279/2.05 |

FOREIGN PATENT DOCUMENTS

| | | |
|---|---|---|
| 1589464 | 5/1970 | France . |
| 2357333 | 2/1978 | France . |
| 1915069 | 10/1969 | Germany . |
| 655528 | 4/1986 | Switzerland . |
| 666068 | 6/1988 | Switzerland . |
| 677973 | 7/1991 | Switzerland . |
| 678341 | 8/1991 | Switzerland . |
| 680672 | 10/1992 | Switzerland . |
| 2018174 | 10/1979 | United Kingdom . |

*Primary Examiner*—Robert C. Watson
*Assistant Examiner*—Thomas W. Lynch
*Attorney, Agent, or Firm*—Young & Thompson

[57] ABSTRACT

A resilient clamp (15) is provided which has the general shape of a dish or of a bell, and which is provided with radial slots (18) in its peripheral part and a central solid annular part. Structure is provide (21) for centering the clamp (15) with respect to the driving shaft (2). The lateral segments of this clamp (15) move radially with respect to the axis of the clamp when the central part (16) thereof is moved along this axis.

13 Claims, 6 Drawing Sheets

DEVICE FOR FASTENING A LAPPING DISK TO THE AXLE OF A MOTOR OF A LAPPING UNIT USED ON THE RAIL OF A RAILWAY

BACKGROUND OF THE INVENTION

For reprofiling rails of railways, use is generally made of railway vehicles of the type described in the Swiss patent 680,672, equipped with several lapping units which can be, for example, of the type described in the Swiss patents 677973, 678341, 655528 or 666068.

All these reprofiling machines have in common the use of lapping units including a motor, the shaft of which drives in rotation a lapping disk, which disk is brought into contact with the rail for its reprofiling.

Obviously, these lapping disks are subject to wear and must be replaced at regular intervals, generally after several hours of work and this necessitates the stopping of the railway vehicle and the manual intervention of trained operators on each lapping unit. For obvious reasons of cost, the time during which the vehicle stands idle must be limited as much as possible and hence the replacement operation of the lapping disks must be carried out as promptly as possible. Furthermore, to avoid major vibrations of the lapping disks which are rotated at a high speed, their centering must be as accurate as possible.

The driving shafts of the lapping units are usually provided with an adaptor onto which is fastened the lapping disk.

Different modes of fastening are known for lapping disks on the adaptor of a lapping unit, the main ones being:

1. The provision of nuts embedded in the body of the lapping disk when the disk is manufactured, which nuts subsequently cooperate with bolts engaged in through bores of the adaptor of the lapping unit. This mode of fastening suffers numerous drawbacks, in particular it complicates the manufacture of the lapping disks because of the use of bolts and does not allow an accurate centering of the lapping disk. Furthermore, the time required for changing a lapping disk is quite long, since six to eight bolts need to be released and tightened again.

2. The use of segments screwed into the periphery of the lapping disk and protruding from its upper surface, these protrusions being threadably engaged in the periphery of the adaptor. Here also, the centering of the lapping disk cannot be carried out accurately and the time needed for changing the lapping disk is unacceptable. Furthermore, the lapping disk thus fastened cannot be used in totality, since the portion extending between the fastening segments is lost.

3. Also, lapping disks are known which are bonded to an aluminum plate and which can subsequently be fastened by a single central bolt to the adaptor driven by the motor of the lapping unit. Such a mode of fastening is described for example in the U.S. Pat. No. 4,292,768. This system makes possible a rapid fastening and centering of the lapping disk, but its cost is much too high, since for each lapping disk, one has to discard or recover an aluminum plate. Furthermore, the manufacture of these lapping disks is made complicated and expensive because of the use of the aluminum plate employed for their fastening.

OBJECT OF THE INVENTION

The aim of the present invention is to propose a mode of fastening of a lapping disk on a driving shaft, driven by the motor of a lapping unit of a vehicle for reprofiling the rails of a railway, which tends to obviate the above-mentioned drawbacks, which makes possible the fastening and the removal of the lapping disk by the actuation of one member only to enable a fast exchange of the lapping disks, which ensures an automatic self-centering of the lapping disk when it is mounted, which ensures an automatic compensation for the tolerances in shape and diameter of the lapping disks, which avoids the addition of any extraneous component to the lapping disk during its manufacture, thus on the one hand reducing its cost and on the other hand making it possible to use any type of lapping disk, and finally which is cheap in that it avoids having to discard or throw away any part other than the lapping disk itself, and requires no fastening plate, bolts or fastening sectors.

BRIEF DESCRIPTION OF THE DRAWINGS

The appended drawings illustrate schematically and by way of example several embodiments of the device for fastening a lapping disk for the reprofiling of a rail of a railway, to the axle of the motor which drives it.

DETAILED DESCRIPTION OF THE PREFERRED EMBODIMENTS

Figure 1:
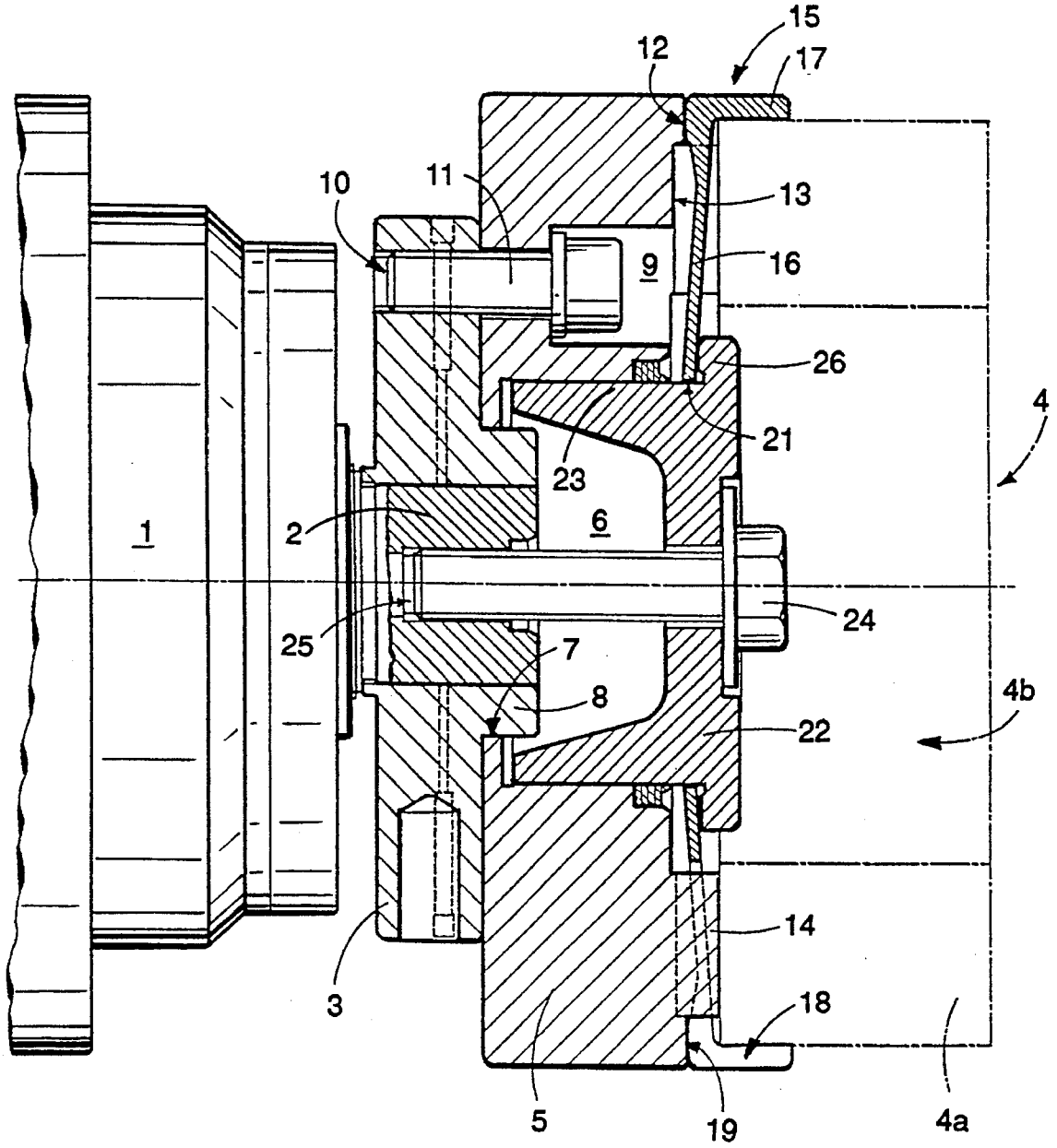
FIG. 1 is an overall cross-sectional view of a first embodiment of the device.

The first embodiment of the device for fastening a lapping disk on an adaptor locked with the driving shaft of a driving motor is illustrated in FIGS. 1 to 5. The driving motor 1 is generally an electric or a hydraulic motor, and it includes an output shaft 2, on which is mounted rigidly a fastening adaptor 3. This adaptor 3 is locked both angularly and axially with the shaft 2, using any known means.

The device which is the object of the present invention makes it possible to fasten accurately, easily and cheaply a lapping disk 4, which offers no particulary feature, i.e. which is formed simply as an abrasive cylindrical block 4*a* of a determined external diameter and having a central through bore 4*b* which can be of any shape, but which is also preferably cylindrical.

The fastening device according to the present invention is provided in this first embodiment with a wheel 5 (FIGS. 2, 3) of a generally cylindrical shape and exhibiting a central hollow 6 opening on its distal front face and a coaxial bore 7 of a smaller diameter than the hollow, which opens on its proximal front face. This bore 7 has a diameter matching the outer diameter of a hub 8 of the fastening adaptor 3 and thus makes possible an accurate centering, for example by simply fitting the wheel 5 on the adaptor 3. The wheel 5 includes stepped bores 9 spaced at regular angular intervals around the axis of the wheel and positioned along a diameter matching that along which are provided threaded similarly spaced bores 10 in the adaptor 3. Thus, headed screws 11 make it possible to lock the wheel 5 to the adaptor 3 and hence to the driving shaft 2.

The distal front face of the wheel 5 has a peripheral support edge 12 surrounding a circular hollows 13 as well as radial lugs or ribs 14 distributed to provide a firm support base for the lapping disk and extending beyond the front surface of the peripheral edge 12.

The fastening device further includes a resilient clamp 15 (FIGS. 4, 5) which has the general shape of a dish, of which the bottom 16 is provided with a central opening 21 of a diameter matching the diameter of the hollow 6 of the wheel 5 and surrounded by a solid part or ring. This bottom is provided with a peripheral edge 17 which is thicker than the bottom 16. From a (see FIG. 5) diameter a corresponding to the diameter on which the internal faces of the lugs 14 are aligned, the bottom 16 and the edge 17 are interrupted by slots 18 dividing the external portion of the clamp or dish 15 into sectors connected together by a central solid portion or ring of the bottom 15. The back face or the proximal front face of the clamp 15 includes an annular peripheral support zone 19 which comes into contact with the peripheral edge 12 of the wheel 5 and a central hollow or a recess 20. Thus, when the clamp 15 is in its operative position against the wheel 5, a space is provided between the confronting front faces of the wheel and of the clamp, which space includes the hollow 13 of the wheel and the recess 20 of the clamp 15.

Preferably, the edge 17 of the clamp 15 forms with the bottom 16 of the same an angle which is slightly lesser than or equal to 90°, and generally comprised between 85° and 90°.

Finally, the fastening device further includes a stepped journal 22, of which the hub 23 has an outer diameter matching the inner diameter of the central opening 21 of the clamp 15 and of the hollow 6 of the wheel 5. This journal 22 is locked in position by a bolt 24, which is threadably engaged in a threaded bore 25 of the driving shaft 2 of the driving motor. The stepped journal 22 further includes a head or edge 26 which presses against the solid ring of the bottom 16 of the clamp 15.

In the non operative state, the inner diameter of the edge 17 of the clamp 15 exceeds slightly that of the external diameter of a lapping disk 4. Thus, when the bolt 24 is not fully tightened, the lapping disk 4 can be introduced into the clamp 15. Then, one only needs to fully tighten the bolt 24 until the front face of the hub 23 of the journal 22 abuts against the wheel 5, thus causing a displacement in the direction of the wheel 5 of the solid central ring of the bottom 16 of the clamp, so that the edges 17 of the sectors of this clamp pivot by the effect of the peripheral edge 12 of the wheel to strongly clamp the lapping disk 4. To remove a worn out lapping disk, one only needs to loosen the bolt 24, the clamp then returns by the effect of its own resilience into the non operative position and releases the periphery of the lapping disk. Accordingly, one only needs to tighten the bolt 24 or loosen it (without fully removing it) to allow the placement or the removal of a lapping disk 4.

Thus, the device described makes it possible to exchange extremely rapidly a lapping disk 4, it makes possible an automatic and an accurate centering thereof whatever may be the tolerance in the shape and the outer diameter of the lapping disk and it is cheap since the lapping disks include no special components such as bolts, sectors or plates.

The tightening force on the lapping disk is achieved by a resilient deformation of the clamp 15. In other versions, when the clamp is tightened, the frictional forces can be increased between the sectors 17 of the clamp and the periphery of the lapping disk by toughening the inner face of the edges 17 or by providing the same with gripping formations, which cooperate with corresponding formations on the peripheral surface of the lapping disk 4, such as grooves.

Figure 1A:
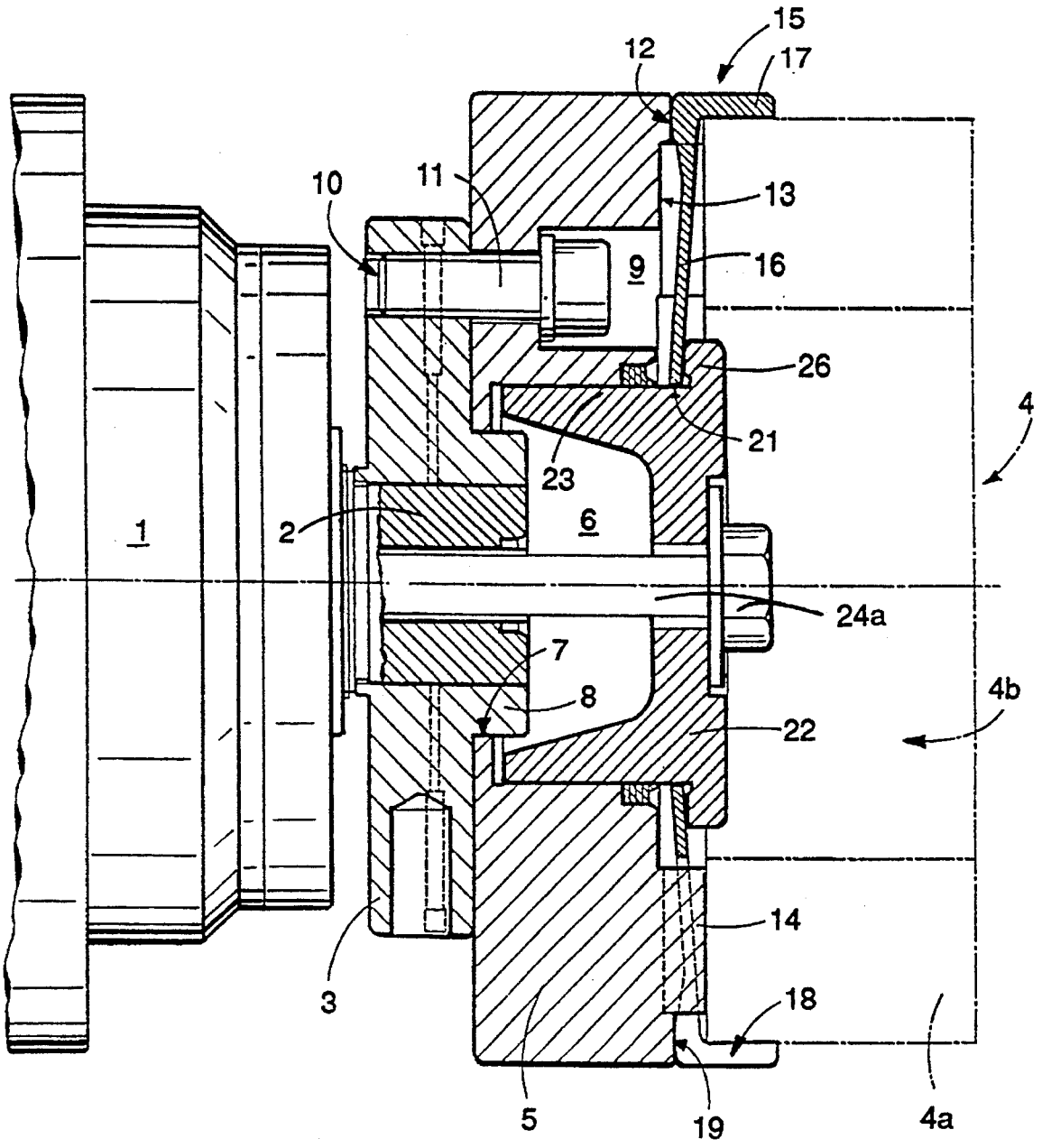
FIG. 1*a* is a view similar to FIG. 1 but of a second, slightly modified embodiment.
Figure 2:
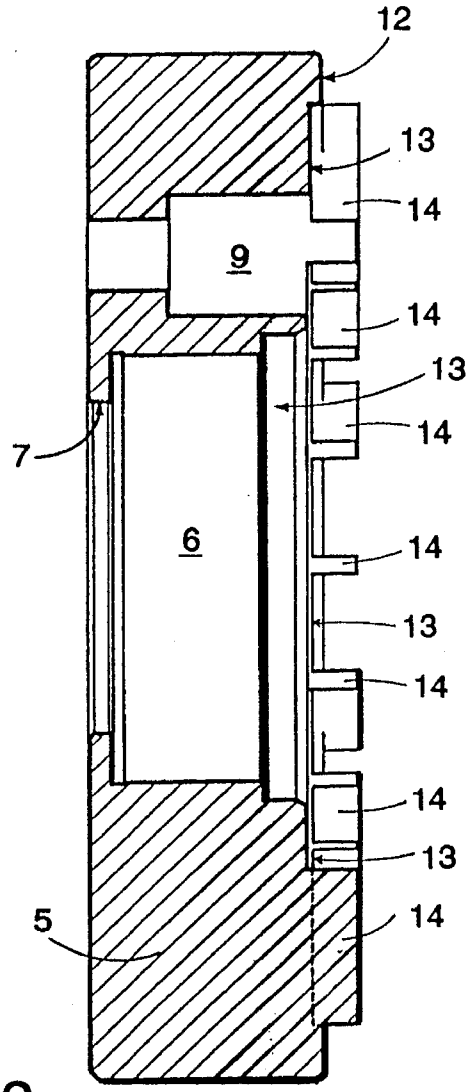
FIG. 2 is a cross-sectional view of the wheel of the device illustrated in FIG. 1
Figure 3:
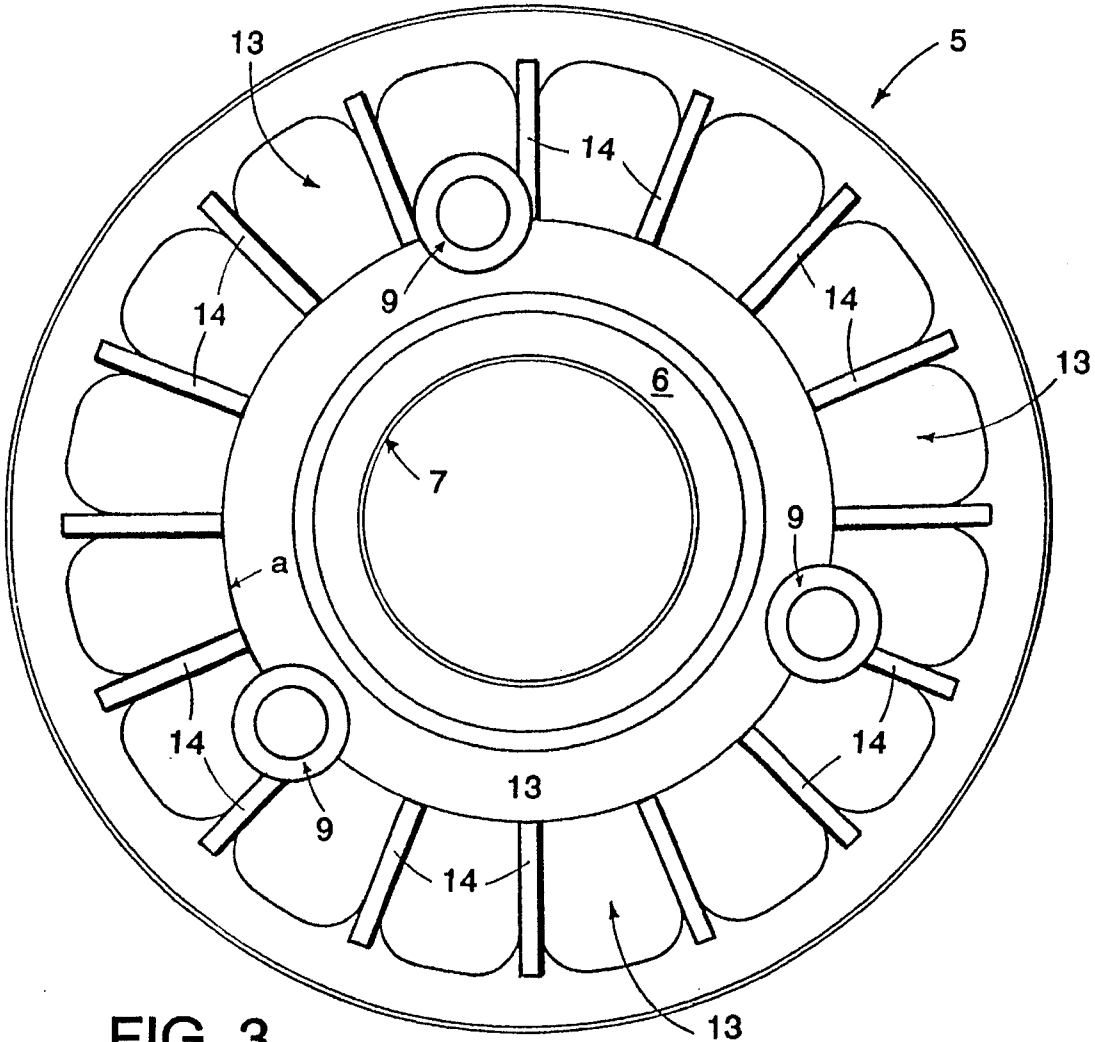
FIG. 3 is a top view of the wheel illustrated in FIG. 2.
Figure 5:
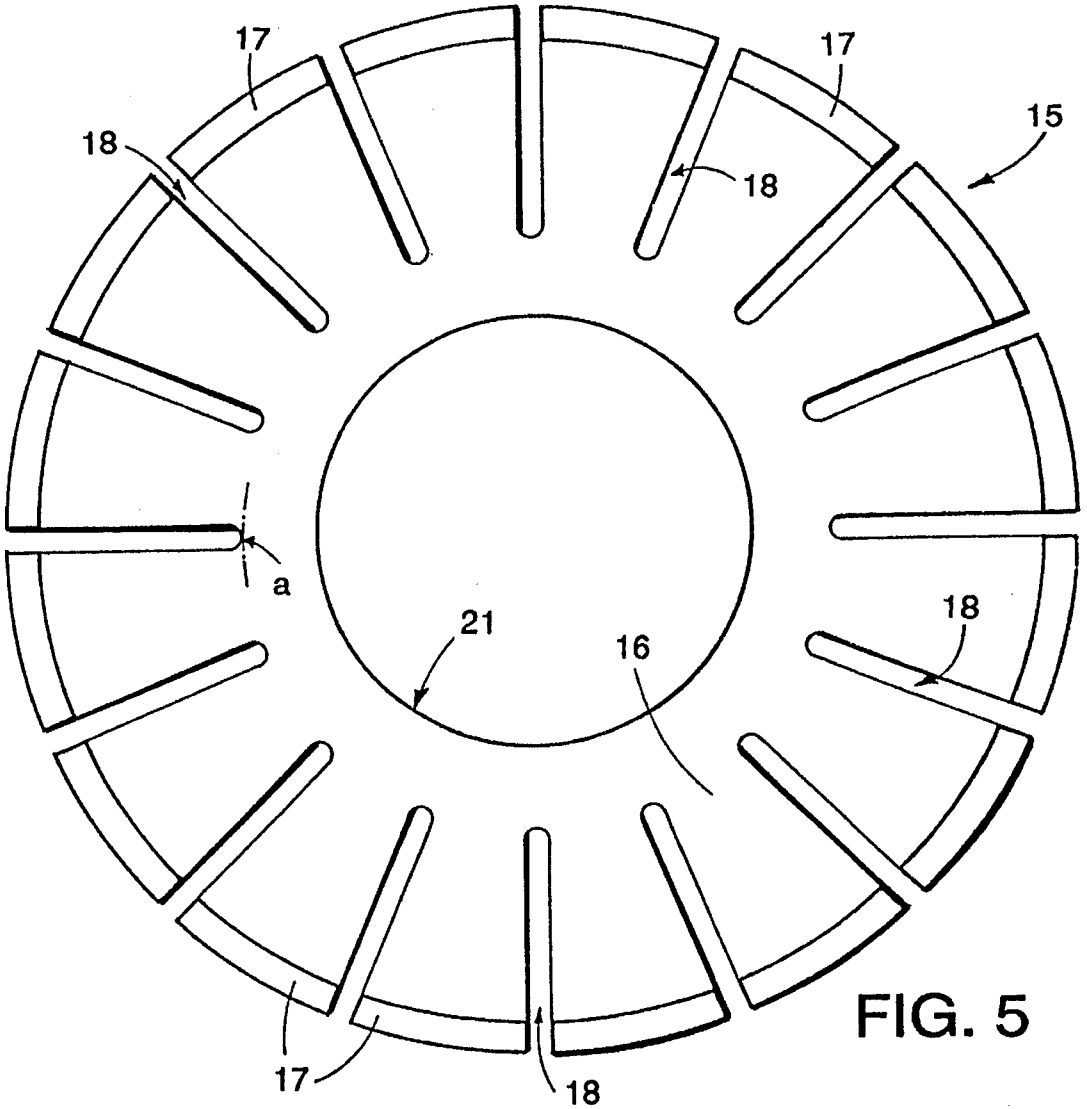
FIG. 5 is a top view of the clamp illustrated in FIG. 4.
Figure 4:
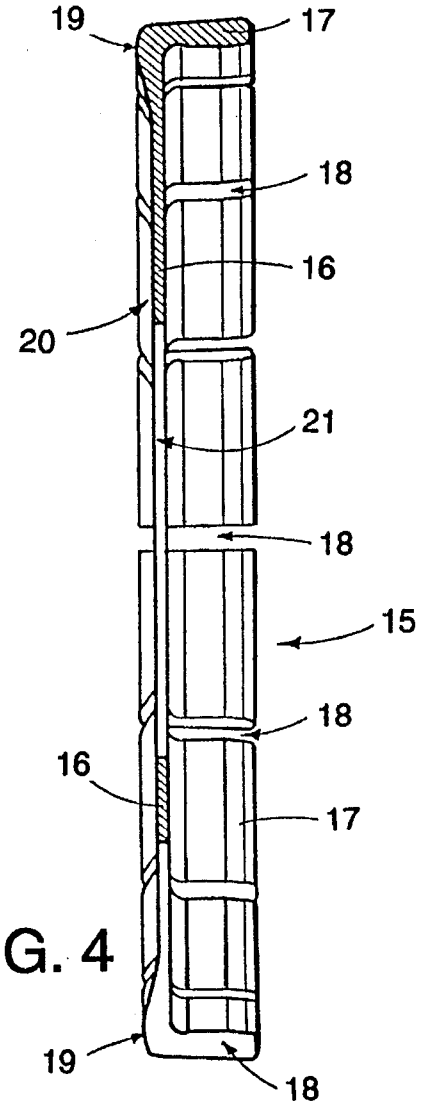
FIG. 4 is a cross-sectional view of the clamp of the device illustrated in FIG. 1

In another version, shown in FIG. 1*a*, the bolt 24 could be replaced by a control 24*a*, extending through the shaft 2 of motor 1 and capable of being actuated axially by means of a hydraulic jack for example. Then, the tightening and the loosening of the clamp 15 can be achieved simply by operating a valve or by actuating an electrovalve, which further simplifies the operations of exchange of a lapping disk and further reduces the time needed.

Figure 6:
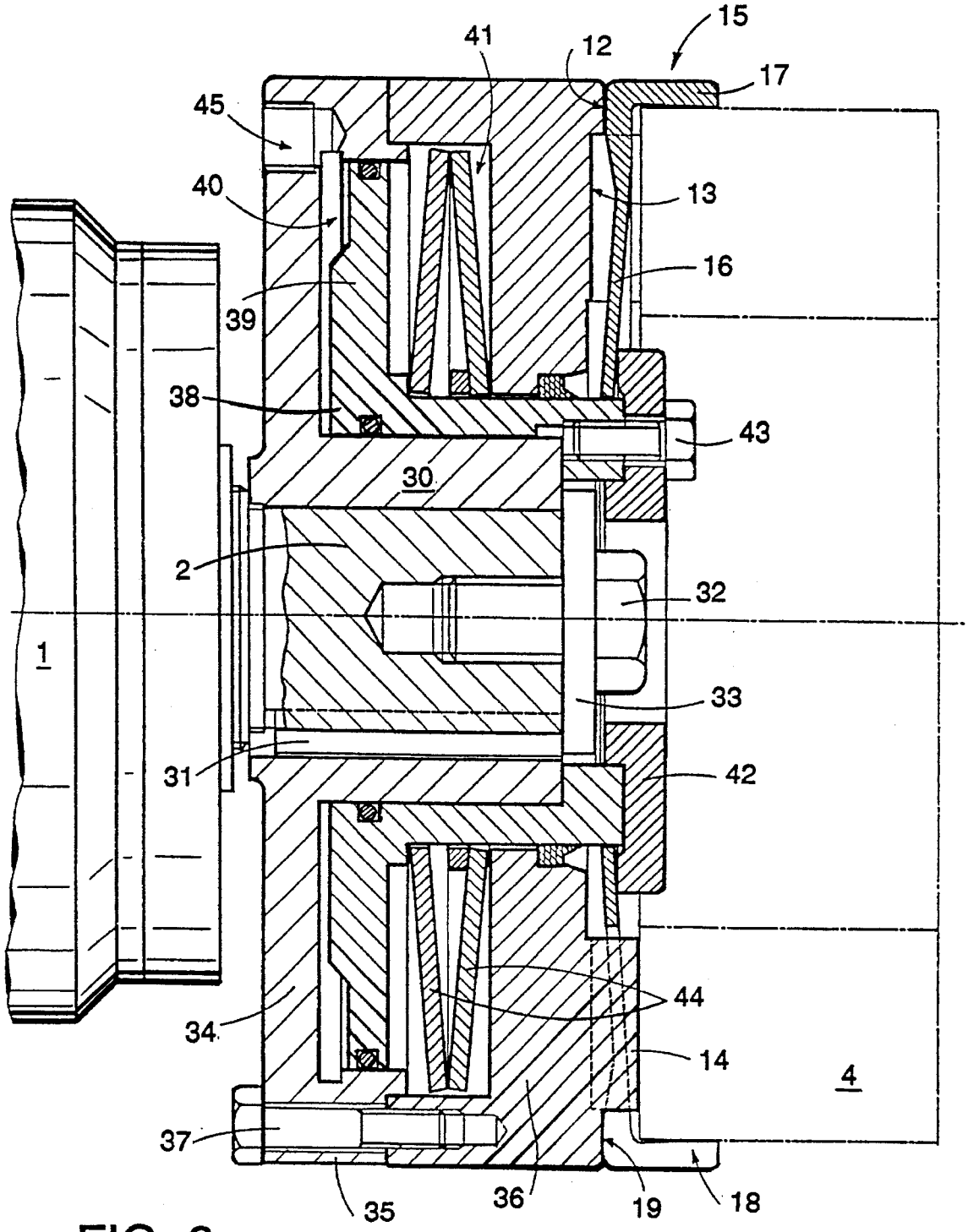
FIG. 6 is an overall cross-sectional view of a third embodiment of the device.

In the third embodiment of the fastening device for a lapping disk of a lapping unit of a vehicle for reprofiling a rail of a railway, shown in FIG. 6. the resilient clamp 15 is identical to that described in relation to the first embodiment, but the wheel of the tightening or fastening device is different and is directly attached to the driving shaft 2, without the use of an intermediate adaptor.

In this third embodiment, the wheel includes a hub 30 slipped on a driving shaft 2 and locked thereto by a key 31 and by the tightening of a bolt 32 threadably engaged in the driving shaft 2, said hub 30 being held between a washer 33 and a shoulder of the driving shaft 2. This hub includes a disk 34 provided with a peripheral edge 35. This wheel further includes a second piece or cover 36 consisting of a disk provided with an annular edge which in the operative position is applied against the edge 35 and maintained in this position by means of the screws 37.

An annular plunger including a hub 38 capable of sliding in a tight relationship on the hub 30 and in a central hole of the cover 36, and a disk 39 extending parallel to the disk 34 and or which the outer edge slides in a tight relationship on the inner face of the edge 35, divides the inner annular space between the hub 30 and the cover 36 into two annular cavities 40, 41.

The distal front face or the cover 36 exhibits a peripheral edge 12 and a central hollow 13, as the corresponding face of the wheel 5 of the first embodiment.

The clamp 15 described previously is placed on the cover 36 and rests through its peripheral edge 19 against the edge 12 or said cover 36, while its central opening 13 allows the passage of the distal end of the plunger. A washer 42 fastened by screws 43 to the distal end of the plunger 38, 39, is seated on the central annular solid part 16 of the clamp 15.

Spring washers 44 are placed inside the cavity 41 located between the plunger 39 and the cover 36, and they urge the plunger 39 towards the disk 34 of the hub of the wheel, which causes the resilient deformation of the clamp 15 for the clamping of a lapping disk 4 as described previously. To loosen the lapping disk 4, a pressurized fluid is injected through the orifice 45 or disk 34 into the cavity 40 to cause a displacement of the plunger 38, 39 relatively to the wheel 30, 36 and hence the suppression of the force applied on the central part or the clamp 15.

Figure 7:
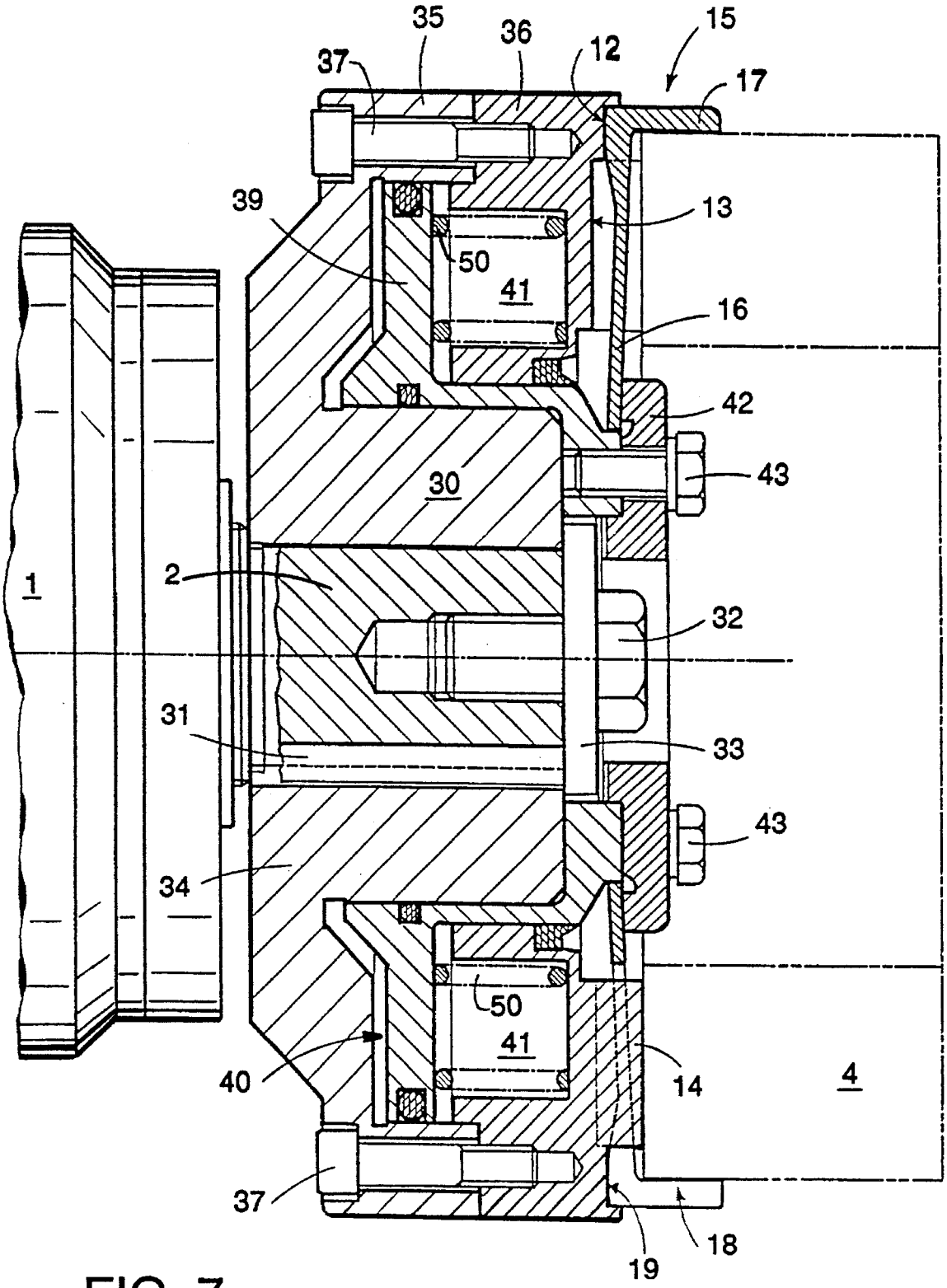
FIG. 7 is an overall cross-sectional view of a fourth embodiment of the device.

The fourth embodiment of the fastening device shown in FIG. 7 is identical to that of the second embodiment which has just been described, only the shape of the components is different. To facilitate the understanding, the corresponding parts are designated by the same reference numerals. The only significant difference is the use of helical springs 50 instead of the spring washers 44, the operations or this third embodiment being identical to those of the previous one.

Clearly, in these two last embodiments, the shape of the distal face of the cover 36 has, as that of the wheel 5 of the first embodiment, an annular peripheral support face 12 and radial ribs or lugs 14 fitting into to slots 18 separating radial sectors of the periphery of the clamp 15 to ensure on the one hand the resilient functioning of the clamp and on the other hand the driving in rotation of this clamp by the wheel and hence by the driving shaft.

All the embodiments and versions described above of the device for fastening a lapping disk to a lapping unit of a vehicle for the reprofiling of the rails of a railway clearly meet the objectives set forth in the preamble, i.e. perfect centering, rapidity of exchange of the lapping disk and a lower cost owing to the fact that there are no residuary bolts, sectors or plates.

Furthermore, all the described embodiments of the invention offer important specific advantages such as a minimal wear of the components of the device owing to the fact that they undergo little motion, a perfect centering and insensitiveness to the abrasive dust generated by the lapping operation.

All these characteristic features and advantages of the device according to the invention are made possible and ran be achieved With the innovative design of the tightening and of the loosening of the lapping disk by means of a resilient dish-shaped clamp, of which the peripheral sectors provided with edges extending approximately at an angle of 90° move inwardly, i.e. in the direction of the axis of the clamp when the central part of the bottom of this dish-shaped clamp is moved axially. The radial peripheral sectors of the clamp, each one being provided with an edge extending at approximately 90° therefrom, are separated by slots 18 designed for receiving the driving ribs carried by the distal face of the wheel.

As can be seen, the principal novelty of the present invention lies in the use for clamping the lapping disk of a resilient clamp of a very particular design, which is shaped as a dish or a bell with radial slots in its outer part, which is centered with respect to the driving shaft by its central bore and which clamps the lapping disk by the lateral segments when the central part is deformed in the direction of the driving shaft.

The remainder of the device, although novel, is merely provided to ensure through appropriate mechanical means said deformation of the clamp and for connecting the same to a driving shaft of the driving motor of the lapping unit.

Obviously, the driving shaft of the fastening device described can be either the shaft of the motor of the lapping unit of a railway vehicle itself, or an auxiliary driving shaft driven indirectly by the motor of the lapping unit.

In order to avoid any misunderstanding, it should be mentioned that the terms "proximal" and "distal" are used in the preceding description to indicate positions with respect to the driving shaft of the device.

I claim:

1. A device for fastening removably a lapping disk to a driving shaft of a lapping unit of a vehicle for reprofiling the rails of railway, characterized in that it includes a resilient clamp having the general shape of a dish or of a bell and including radial slots in its peripheral part and a central annular solid part; means for centering the clamp with respect to the driving shaft; lateral segments of this clamp moving radially with respect to an axis of the clamp when said central part thereof is moved along said axis; and fluid pressure means for moving said central part along said axis; wherein the fastening means of the clamp to the driving shaft includes a wheel, of which a distal face includes radial ribs or lugs engaged with radial slots separating radial sectors of the clamp, this distal face comprising amongst others a peripheral support edge and a central hollow opening allowing axial displacement of said central part of the clamp when said central part abuts along its periphery against the peripheral support edge of the wheel.

2. A device according to claim 1, characterized in that the wheel is rigidly locked axially and angularly to the driving shaft.

3. A device according to claim 2, characterized in that said solid annular part of the clamp is connected, by a control and fastening member, to the driving shaft.

4. A device according to claim 3, characterized in that the fastening and control member consists of a stepped journal slidably engaged in the wheel and abutting against said central annular solid part of the clamp, and of a bolt connecting this journal to the driving shaft.

5. A device according to claim 3, characterized in that the fastening and control member consists of a stepped journal slidaby engaged in the wheel and abutting against said central annular solid part of the clamp, and of a control rod slidably engaged inside the driving shaft, of which an end is fastened to this journal.

6. A device according to claim 1, characterized in that the wheel consists of two parts defining between them a cavity partitioned into two chambers by a plunger comprising a rod emerging outside the distal face of the wheel and connected to said central annular solid part of the clamp.

7. A device according to claim 6, characterized in that the chamber located between the plunger and the cover of a wheel encloses resilient means which tend to separate the two pieces from each other to cause the clamping action of the clamp.

8. A device according to claim 7, characterized in that the resilient means consist either of stacked spring washers or of helical springs.

9. A device for fastening removably a lapping disk to a driving shaft of a lapping unit of a vehicle for reprofiling the rails of a railway, characterized in that it includes a resilient clamp having the general shape of a dish or of a bell and including radial slots in its peripheral part and a central annular solid part; means for centering the clamp with respect to the driving shaft; lateral segments of this clamp moving radially with respect to an axis of the clamp when said central part thereof is moved along said axis, wherein the fastening means of the clamp to the driving shaft includes a wheel, of which a distal face includes radial ribs or lugs engaged with radial slots separating radial sectors of the clamp, this distal face comprising amongst others a peripheral support edge and a central hollow opening allowing axial displacement of said central part of the clamp when said central part abuts along its periphery against the peripheral support edge of the wheel, and wherein the wheel consists of two parts defining between them a cavity partitioned into two chambers by a plunger comprising a rod emerging outside the distal face of the wheel and connected to said central annular solid part of the clamp, and wherein the chamber located between the plunger and a cover of the wheel encloses resilient means which tend to separate the two pieces from each other to cause the clamping action of the clamp, and wherein the other chamber, located between the plunger and a hub of the wheel is connected to a source of pressurized fluid for controlling the movement of the plunger in the wheel for releasing the clamp.

10. A device for fastening removably a lapping disk to a driving shaft of a lapping unit of a vehicle for reprofiling the rails of a railway, characterized in that it includes a resilient clamp having the general shape of a dish or of a bell and including radial slots in its peripheral part and a central annular solid part; means for centering the clamp with respect to the driving shaft; lateral segments of this clamp moving radially with respect to an axis of the clamp when said central part thereof is moved along said axis; and rotatable screw threaded means for moving said central part along said axis.

11. A device according to claim 10, said screw threaded means comprising a screw threaded bolt rotatably carried by said driving shaft, and means interconnecting said bolt with said central part whereby rotation of said bolt moves said bolt and said central part along said axis.

12. A device according to claim 11, in combination with a said lapping disk, said lapping disk being annular and having a central opening through which said bolt is exposed to provide access to rotate said bolt.

13. A device for fastening removably a lapping disk to a driving shaft of a lapping unit of a vehicle for reprofiling the rails of a railway, characterized in that it includes a resilient clamp having the general shape of a dish or of a bell and including radial slots in its peripheral part and a central annular solid part; means for centering the clamp with respect to the driving shaft; lateral segments of this clamp moving radially with respect to an axis of the clamp when said central part thereof is moved along said axis; and fluid pressure means for moving said central part along said axis; wherein a bottom of the clamp has a central opening surrounded by a solid annular part and by a peripheral part divided into radial sectors by slots, each radial sector including a peripheral edge having on its proximal face an annular support face; in that said peripheral edge extends substantially perpendicularly with respect to the plane of the bottom of the clamp, internal surfaces of said edges defining together a clamping surface located on a diameter matching the outer diameter of the lapping disk to be fastened; and in that said device includes means enabling on the one hand the fastening of this clamp to the driving shaft and on the other hand the axial displacement of the solid annular bottom of the clamp with respect to the plane of the annular support face of the peripheral edge of this clamp between a clamping position and a release portion of the lapping disk by said edges of the sectors of the clamp.

* * * * *